US006268696B1

(12) United States Patent
Dolan et al.

(10) Patent No.: US 6,268,696 B1
(45) Date of Patent: Jul. 31, 2001

(54) MERCURY AND LEAD FREE HIGH PRESSURE SODIUM LAMP

(75) Inventors: Robert B. Dolan, Manchester, NH (US); John L. Plumb, Danvers; Elliot F. Wyner, Peabody, both of MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/244,252

(22) Filed: Feb. 3, 1999

(51) Int. Cl.[7] ..... H01J 17/20; H01J 61/12; H01J 17/16; H01J 61/30; H01J 61/35

(52) U.S. Cl. ..... 313/570; 313/493; 313/573; 313/634; 313/635; 313/636; 313/637; 313/638; 501/64; 501/66

(58) Field of Search ..... 313/491–493, 313/634–638, 643, 25, 110, 112, 573; 501/11, 46, 48, 50–52, 62, 64, 66, 69, 72, 89, 100–101, 103–104, 105, 107, 108, 123, 126–127, 135, 152–154, 904–905

(56) References Cited

U.S. PATENT DOCUMENTS 5,682,082 10/1997 Wei et al. ..... 313/636
6,118,216 * 9/2000 Marlor ..... 313/636

FOREIGN PATENT DOCUMENTS 0790639 8/1997 (EP) ..... H01J/61/82
7272680 10/1995 (JP) ..... H01J/61/22

* cited by examiner

*Primary Examiner*—Nimeshkumar D. Patel
*Assistant Examiner*—Mack Haynes
(74) *Attorney, Agent, or Firm*—William H. McNeill

(57) ABSTRACT

A long-life, environmentally disposable high pressure sodium lamp comprising: an arc tube capable of withstanding internal wall temperatures of 1250 to 1300° C. and having electrodes sealed therein and being designed for operation at a given wattage; a discharge space within the arc tube and an arc generating and sustaining medium within the discharge space, the medium being mercury-free and containing sodium in an amount of about 0.02 mg to 0.06 mg/watt of designed operation, and xenon at a pressure of 100 to 200 Torr; mounting means supporting the arc tube within a glass outer envelope, the glass outer envelope being lead-free and arsenic-free; and an electrically conductive base closing the outer envelope and containing lead-in wires affixed to the electrodes, the lead-in wires being attached to the base by welding.

6 Claims, 1 Drawing Sheet

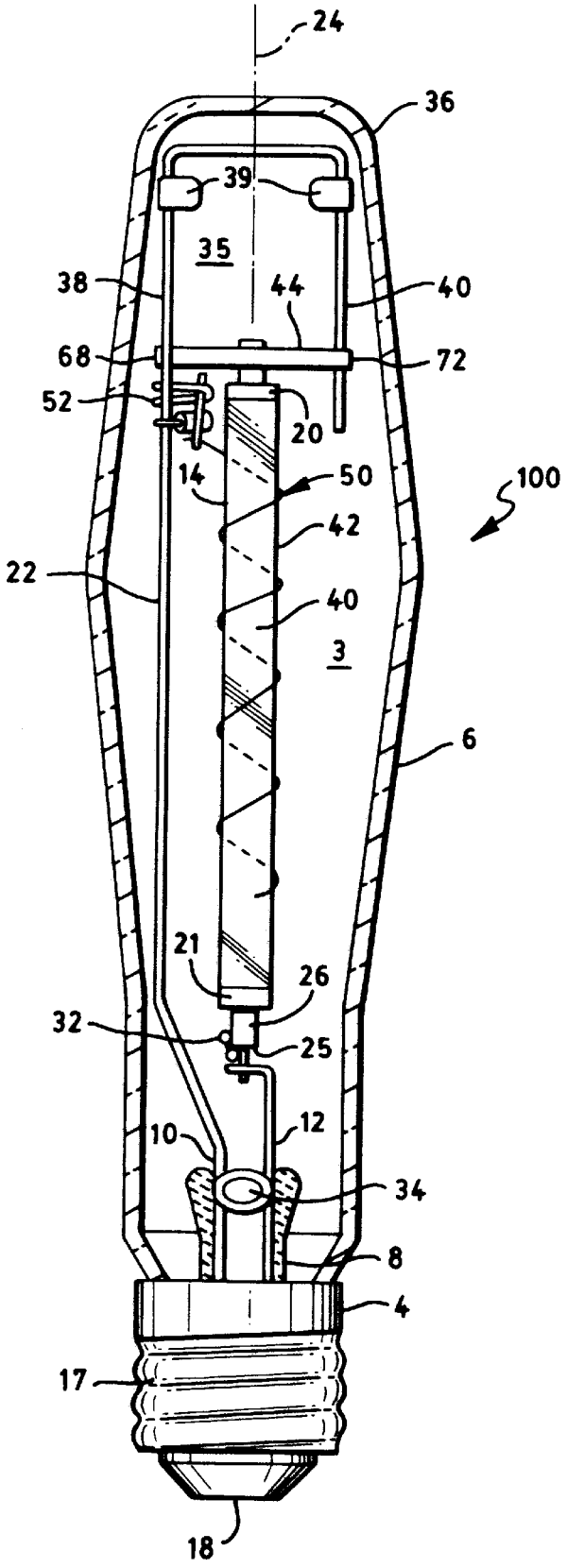
24
36
39
35
38
44
40
68
72
52
20
14
50
100
42
22
40
3
6
21
26
32
25
10
12
34
8
4
17
18

MERCURY AND LEAD FREE HIGH PRESSURE SODIUM LAMP

TECHNICAL FIELD

This invention relates to discharge lamps and more particularly to high pressure sodium lamps. Still more particularly, it relates to such lamps that are environmentally disposable.

BACKGROUND ART

Discharge lamps generally include a discharge chamber of quartz or alumina supported within an envelope of borosilicate or aluminosilicate glass. Disposal of these lamps at the end of life has been deemed an environmental hazard because the outer envelope glass includes lead and arsenic and the discharge chamber includes mercury. Further, the electrically conductive base may have the in-leads for the lamp attached thereto by a lead-based solder. The lead, arsenic and mercury are presumed to be hazardous to animal and human health.

DISCLOSURE OF INVENTION

It is, therefore, an object of the invention to obviate the disadvantages of the prior art.

It is another object of the invention to provide an environmentally safe lamp that may be disposed of easily.

Yet another object of the invention is the enhancement of lamp disposal.

These objects are accomplished, in one aspect of the invention, by the provision of a long-life, environmentally disposable high pressure sodium lamp comprising: an arc tube capable of withstanding internal wall temperatures of 1250 to 1300° C. and having electrodes sealed therein and being designed for operation at a given wattage; a discharge space within the arc tube and an arc generating and sustaining medium within the discharge space, the medium being mercury-free and containing sodium in an amount of about 0.02 mg to 0.06 mg/watt of designed operation, and xenon at a pressure of 100 to 200 Torr; mounting means supporting the arc tube within a glass outer envelope, the glass outer envelope being lead-free and arsenic-free; and an electrically conductive base closing the outer envelope and containing lead-in wires affixed to the electrodes, the lead-in wires being attached to the base by welding.

Lamps so constructed may be safely and legally disposed of in conventional land fills.

BRIEF DESCRIPTION OF THE DRAWINGS

The single FIGURE illustrates a lamp embodying the invention.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Referring now to the drawing with greater particularity, there is shown a high pressure sodium vapor lamp 100 having a vitreous outer envelope 6 with a standard mogul screw base 4 attached to the stem end which is shown lowermost in the figure. A reentrant stem press 8 has a pair of relatively heavy lead-in conductors 10 and 12 extending through the stem 8 and having outer ends of conductors 10 and 12 connected to the screw shell 17 and eyelet 18 by welding, thus eliminating the need for lead-bearing solder.

The lamp 100 has an inner envelope or arc tube 14 centrally located within the outer envelope 6. The arc tube 14 is comprised of a length of light transmitting ceramic formed of polycrystalline alumina ceramic that is translucent. The arc tube 14 contains a charge of an arc generating and sustaining medium which is mercury-free and contains sodium in an amount of 0.02 to 0.06 mg/watt of designed lamp operation (for lamps of 70 to 150 watt operation), and 100 to 200 Torr of xenon, preferably, 140 to 160 Torr. The amount of sodium present is enough to operate the lamp in a saturated mode for the 24,000 hour life. The upper end of the arc tube 14 is closed by an alumina ceramic plug 20 through which a niobium in-lead 26 projects and which supports an upper electrode (not shown) within the arc tube 14. The lower end of arc tube 14 has a closure which comprises a ceramic plug 21 through which extends a thin-walled niobium tube 26. The niobium tube 26 serves as an in-lead for arc tube 14. The shank of the lower electrode (not shown) of arc tube 14 projects into tube 26 and may be locked in place by crimping the tube 26 about the lower electrode at location 25. The arc tube 14 has a tungsten wire 50 coiled thereabout. The wire 50 is connected to one of the electrodes by a thermal switch 52 and is placed between the electrodes where the lowest breakdown voltage is achieved. The thermal switch opens when the lamp is warm so as to minimize electric fields across the tube wall.

The arc tube 14 is of primary interest to the invention and has an arc chamber 40 defined by walls 42. The arc tube comprises magnesia in an amount of about 0.020 to 0.050 wgt. percent; zirconia in an amount of about 0.018 wgt. percent, and about 0.035 wgt. percent yttria; balance alumina. Such an arc tube is capable of operating with internal wall temperatures of 1250 to 1300° C. and is shown in U.S. Pat. No. 5,682,082, which is assigned to the assignee of the instant invention.

The outer envelope 6 is lead-free and arsenic-free and preferably is a borosilicate glass having a composition of 13.5 to 16.8 wt. % $B_2O_3$, 2.0 to 4.0 wt % $Al_2O_3$, 2.0 to 5 wt. % $Na_2O$, 1.3 to 4.0 wt. % $K_2O$, from 0 to 0.30 wt. % $Li_2O$, 0 to 1.0 wt. % CaO, 0 to 1.0 wt. % MgO, 0.05 to 0.17 wt. % $Fe_2O_3$, 0.005 to 0.06 wt. % $CeO_2$, and the balance $SiO_2$. Preferably, the amounts of $Fe_2O_3$ and $CeO_2$ comprise no greater than 0.19 wt. % and the sum of the amounts of $Na_2O$, $K_2O$ and $LiO_2$ comprise no greater that 7.5 wt. %. Such a glass is shown, for example in Ser. No. 09/085,989, filed May 28, 1998, now U.S. Pat. No. 6,118,216 and assigned to the assignee of the present invention.

There is thus provided and environmentally safe, easily disposable discharge lamp that is free of lead, including lead solder, and mercury and arsenic. The lamp has a 24,000 hour life.

While there have been shown and described what are at present considered the preferred embodiments of the invention, it will be apparent to those skilled in the art that various changes and modifications can be made herein without departing from the scope of the invention as defined by the appended claims.

What is claimed is:

1. A long-life, environmentally disposable high pressure sodium lamp comprising: an arc tube capable of withstanding internal wall temperatures of 1250 to 1300° C. and having electrodes sealed therein and being designed for operation at a given wattage; a discharge space within said arc tube and an arc generating and sustaining medium within said discharge space, said medium being mercury-free and containing sodium in an amount of about 0.02 mg to 0.06 mg/watt of designed operation, and xenon at a pressure of 100 to 200 Torr; mounting means supporting said arc tube within a glass outer envelope, said glass outer envelope being lead-free and arsenic-free; and an electrically conductive base closing said outer envelope and containing lead-in wires affixed to said electrodes, said lead-in wires being attached to said base by welding.

2. The lamp of claim 1 wherein said sodium amount is sufficient to cause said lamp to operate in a saturated mode for at least 24,000 hours.

3. The lamp of claim 1 wherein said arc tube is formed from polycrystalline alumina containing minor amounts of MgO, $ZrO_2$, and $Y_2O_3$.

4. The lamp of claim 3 wherein said minor amounts are about 0.02 wt. % MgO; 0.018 wt. % $ZrO_2$; and 0.035 wt. % $Y_2O_3$.

5. The lamp of claim 1 wherein said outer envelope is a borosilicate glass.

6. The lamp of claim 5 wherein said borosilicate glass has a composition consisting essentially of: $B_2O_3$, $Al_2O_3$, $Fe_2O_3$, $Na_2O$, $K_2O$, $CeO_2$, and $SiO_2$, minor amounts of $Li_2O$, CaO, and MgO, said minor amount totaling less that 2.5 wt. %.

* * * * *